US005415556A

United States Patent [19]

Schroll

[11] Patent Number: 5,415,556

[45] Date of Patent: May 16, 1995

[54] HYBIRD PACKAGING OF INTEGRATED I/O INTERFACE DEVICE AND CONNECTOR MODULE

[75] Inventor: Ross E. Schroll, Fairport, N.Y.

[73] Assignee: Xerox Corporation, Stamford, Conn.

[21] Appl. No.: 166,051

[22] Filed: Dec. 6, 1993

[51] Int. Cl.[6] ..... H01R 9/07

[52] U.S. Cl. ..... 439/77; 439/516; 439/925

[58] Field of Search ..... 439/66, 67, 68, 71, 439/77, 404, 516, 925

[56] References Cited

U.S. PATENT DOCUMENTS

| | | | |
|---|---|---|---|
| 4,932,873 | 6/1990 | La Shier | 439/77 |
| 5,037,308 | 8/1991 | Bryce et al. | 439/52 |
| 5,044,964 | 9/1991 | Minerd et al. | 439/67 |
| 5,125,846 | 6/1992 | Sampson et al. | 439/66 |

*Primary Examiner*—Neil Abrams
*Attorney, Agent, or Firm*—Ronald F. Chapuran

[57] ABSTRACT

A connector module for connecting at least one of an input device and an output device to a multi-wire bus including a first stage supporting the multi-wire bus, a second stage having an IC chip mounted on a lead frame, the lead frame including first electrical connections for connecting the input and output devices to the IC chip and second electrical connections including a plurality of stamped metal contacts that are bent with one end formed for an insulation displacement contact with multi-signals between the multi-wire bus and the input and output devices, and a stage fastener for interlocking the first stage to the second stage. Also disclosed are a first plurality of conductive patterns for connecting the input and output devices to the IC chip, and a second plurality of conductive patterns for connecting the multi-wire bus to the IC chip the second plurality of conductive patterns including button contacts for conveying signals between the multi-wire bus and the input and output devices.

3 Claims, 6 Drawing Sheets

HYBIRD PACKAGING OF INTEGRATED I/O INTERFACE DEVICE AND CONNECTOR MODULE

BACKGROUND OF THE INVENTION

The invention relates to an integrated input/output interface device and connector module, and more particularly, to a connector module readily adapted for interconnection to a variety of buses and conductors.

Various connector modules are well known in the prior art. For example, U.S. Pat. No. 4,420,794 discloses key device carrying an integrated circuit chip for dual in-line package that permits connecting the chip into a circuit board such as drum and exterior openings of the housing or cabinet carrying the circuit board. U.S. Pat. No. 5,044,964 discloses a connector module having a molded plastic base supporting an IC chip and having punch holes to disconnect an input circuit for programming the module to various configurations.

U.S. Pat. No. 5,076,801 discloses a connector module with insulation displacement interconnect means for connection to a common bus and U.S. Pat. No. 5,037,308 relates to a connector module having a spring clip mechanism for interconnecting the module to a bus system.

A difficulty with the prior art devices is the lack of the flexibility of the configuration for interconnecting to buses and conductive frames, as well as connection to other connector modules. Another difficulty is the complexity of fabrication and configuration of connector devices, in particular, the complexity of fabricating and forming external contacts with other devices.

It is an object of the present invention, therefore, to provide a new and improved integrated input/output connector module that is adapted for interconnecting to buses and conductive frames, printed wiring boards as well as connecting to other connector modules. It is another object of the present invention to provide a connector assembly having a single stamped lead frame providing all the external connections. Another object of the present invention is to be able to provide standard and custom formed contacts for interconnection to conductor frames and standard connectors. Further advantages of the present invention will become apparent as the following description proceeds and the features characterizing the invention will be pointed out with particularity in the claims annexed to and forming a part of this specification.

SUMMARY OF THE INVENTION

Briefly, the present invention is a connector module for connecting at least one of an input device and an output device to a multi-wire bus including a first stage supporting the multi-wire bus, a second stage having an IC chip mounted on a lead frame, the lead frame including first electrical connections for connecting the input and output devices to the IC chip and second electrical connections including a plurality of stamped metal contacts that are bent with on end formed for an insulation displacement contact with the multi-wire bus for connecting the multi-wire bus to the IC chip for conveying signals between the multi-wire bus and the input and output devices, and a stage fastener for interlocking the first stage to the second stage. In addition, there is provided a first plurality of conductive patterns for connecting the input and output devices to the IC chip, and a second plurality of conductive patterns for connecting the multi-wire bus to the IC chip, the second plurality of conductive patterns including both standard custom contacts for conveying signals between the multi-wire bus and the input and output devices.

DESCRIPTION OF THE DRAWINGS

For a better understanding of the present invention, reference may be had to the accompanying drawings wherein the same reference numerals have been applied to like parts and wherein.

DETAILED DESCRIPTION OF THE INVENTION

Figure 1:
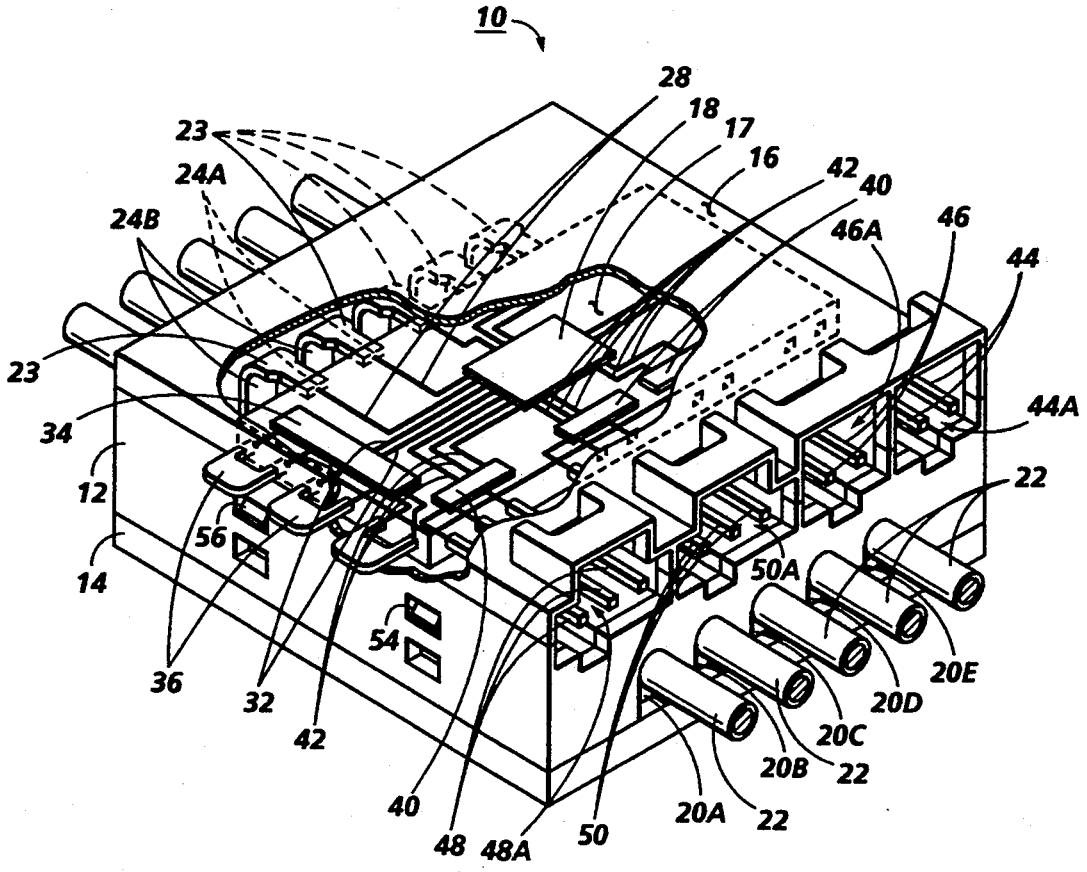
FIG. 1 is a connector module incorporating features in accordance with the present invention.

FIG. 1 illustrates a three stage or three-piece module generally shown at 10 in accordance with the present invention. A first stage comprises a molded base 12, a second stage 14 is a bottom cover, and the third stage is a one-piece lead frame generally shown at 16 supporting thereon integrated circuit package 17 including an integrated or chip circuit 18. The molded base 12 includes a plurality of molded cavities 20A through 20E disposed on the underside of the base 12 to allow the wires 22 of a five-wire bus to extend therethrough. The overall dimensions of the three-stage module is approximately 14 millimeters high, 37 millimeters, and 36 millimeters wide.

Five insulation displacement connectors (IDCs) 23 extend from electrical connection at one end to the integrated circuit 18 for engagement with the wires 22 of the five-wire bus at the other end. As illustrated, the IDCs 23 are generally L-shaped with the base of the L or tapered portion 24A being embedded in the integrated circuit package 17 with the vertically positioned portion 24B of the L-shaped IDCs 23 terminating at the distal end into essentially V-shaped forms as is well known in the insulation displacement connector design. The V-shaped ends or edges of the insulation displacement connectors are comprised of relatively sharp metal edges in order to penetrate the insulation of the wires 22 for direct metal-to-metal contact of the IDCs 23 with the wires 22. The metal-to-metal contact is accomplished when the IDCs are pressed into engagement with the wires 22. Another manner of piercing the insulation of the wires 22 is during the harnessing stage of assembly when the wires 22 are pulled through the molded cavities 20A–20E of the base 12.

The five-wires of the five-wire bus generally represent a serial input data (SID) line, a serial output data (SOD) line, a grounded line, a voltage source line and a clock pulse line. The integrated circuit package 17 supports the chip 18 and also supports various conductive traces such as traces 28 for interconnecting the IDCs 23 to the chip 18. In addition, a representative conductive trace 32 is illustrated connected to pad 34 in turn connected to the program tabs 36 for configuring a connector module as will be described below. In addition, conductive pads 40 are interconnected to the integrated circuit chip 18 by associated conductive traces 42. In turn, the conductive pads 40 are connected to dual conductive pins 44 and 46 and to triple conductive pins 48 and 50. As illustrated in FIG. 1, the dual conductive pins 44 A and 46 are disposed in dual pin sockets 44A and 46A and the triple conductive pins 48 and 50 are disposed in triple conductive pin sockets 48A and 50A, respectively. The sockets 44A, 46A, 48A, and 50A are disposed for interfacing with not shown connectors or jacks connected to various input and output devices such as switches, sensors, solenoids, and motors.

Various clamp fasteners such as shown at 54 and 56 are integrally formed onto the bottom cover or section 14 of the module to engage apertures to snap the base 12 and bottom cover 14 into engagement. It should be noted that any suitable connecting technique is contemplated such as described above in order to fasten and secure the component parts of the connector module together. The program tabs as shown at 36 are generally interconnected to a not shown ground wire and can be selectively interconnected to a given conductive trace connected to the chip 18 to selectively ground a corresponding node on the chip 18. Three program tabs are illustrated, but it should be understood that generally another three program tabs would extend from the distal end of the integrated circuit package 18. The program tabs are used to designate a particular address for input-output configuration for a particular connector module. In one embodiment, four of the tabs designate a particular address (a total of 16 possible addresses for four tabs) and the remaining tabs designate the input-output configuration of the module. Programming unique addresses is accomplished by the removal of combinations of tabs, creating logical '1's and '0's.

All of the contacts, the installation displacement contacts 23, the program tabs 36, and the dual pins 44–46 and the triple pins 48 and 50 are all formed from a one-piece lead frame forming the top section of the module 10. The chip 18 is suitably mounted on a substrate with conductive pieces and conductive pads for interconnection to the external electrical contacts. The integrated circuit package 17 is molded over the lead frame and the various connectors are formed as required.

Figure 2:
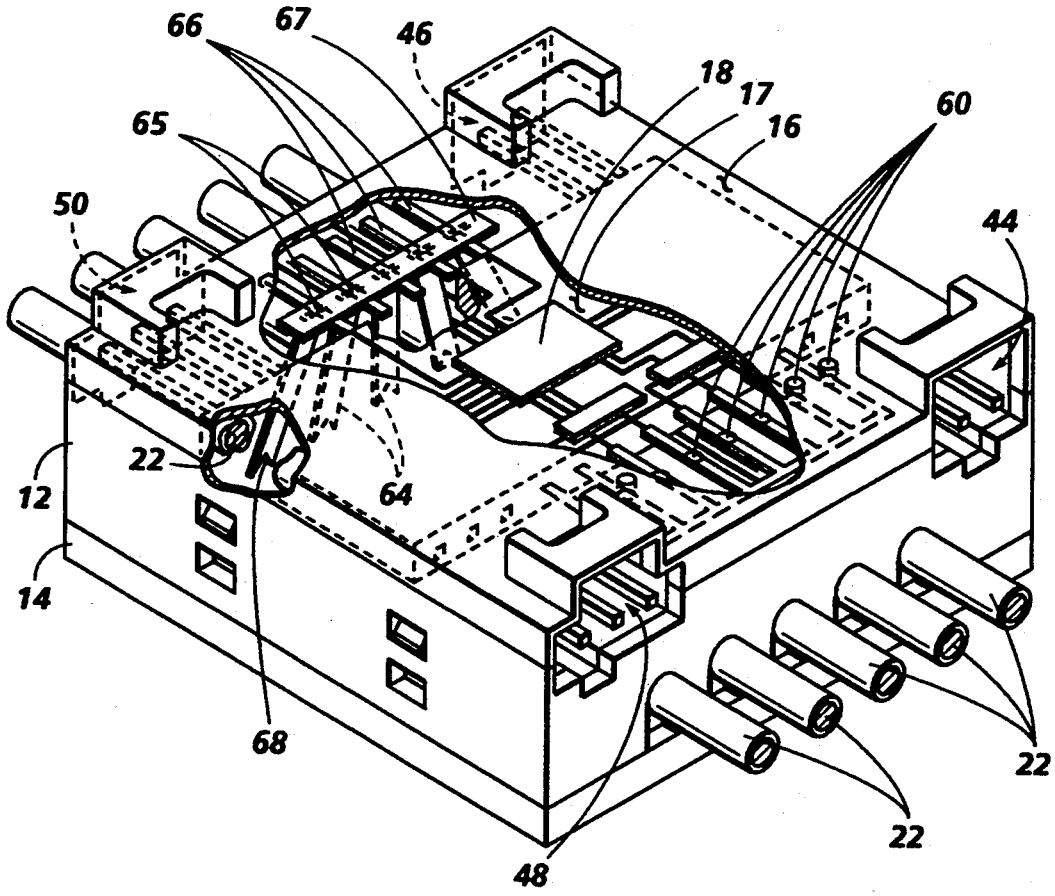
FIG. 2 is a modification of the connector module of FIG. 1 in accordance with the present invention.

With reference to FIG. 2, there is shown an alternate embodiment of an input-output connector. Specifically, rather than the programming tabs as shown in FIG. 1, FIG. 2 illustrates programming punchouts 60 disposed in communication with conductive traces 62 whereby application of pressure on the punchout 60 opens the particular conductive tray 62 to set a logic 0 or 1 in the control to configure the conductor for input and output devices. Also, as shown in FIG. 2, the dual conductive pins 44 and 46 are now disposed at the corners on one side of the module and the triple conductive pins 48 and 50 now disposed at the corners on the opposite side of the connector module. Finally, as illustrated by the dotted lines at 64 there is an insulation displacement contact piece that joins at 65 forms a connecting conduit 67 between each of the wires 22 of the common bus and each of the conductive pins 66 extending from the integrated circuit package 17. In practice, each of the insulation displacement contact pieces 64 incorporates a V-shaped end as illustrated at 68 to pierce the insulation on each of the wires 22. Preferably the pieces 64 are substantially heavier than the connectors 23 as shown in FIG. 1 to ensure the displacement of the insulation of the wires 22 and to safeguard from potential breakage or interruption of the contacts 23.

Figure 3:
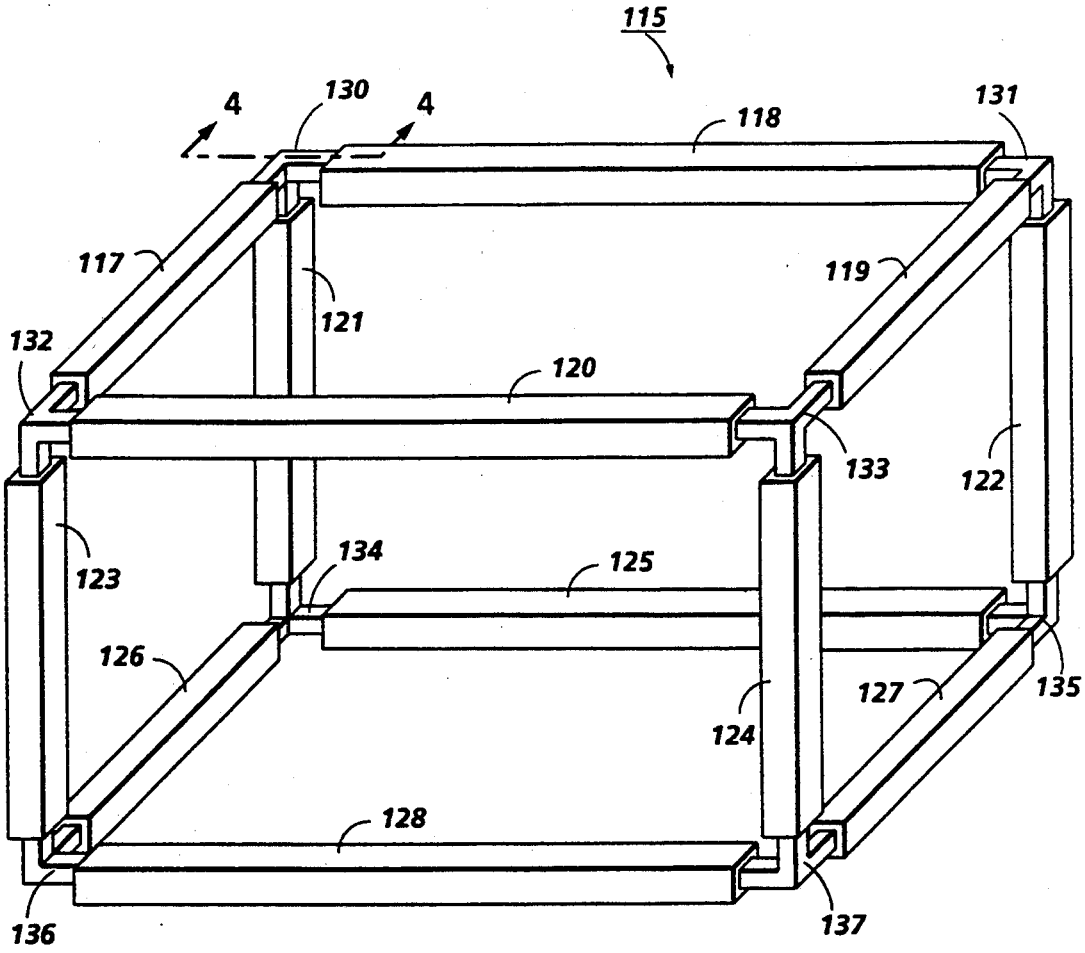
FIGS. 3 and 4 illustrate the use of frame conductors for use with the connector modules of the present invention.
Figure 4:
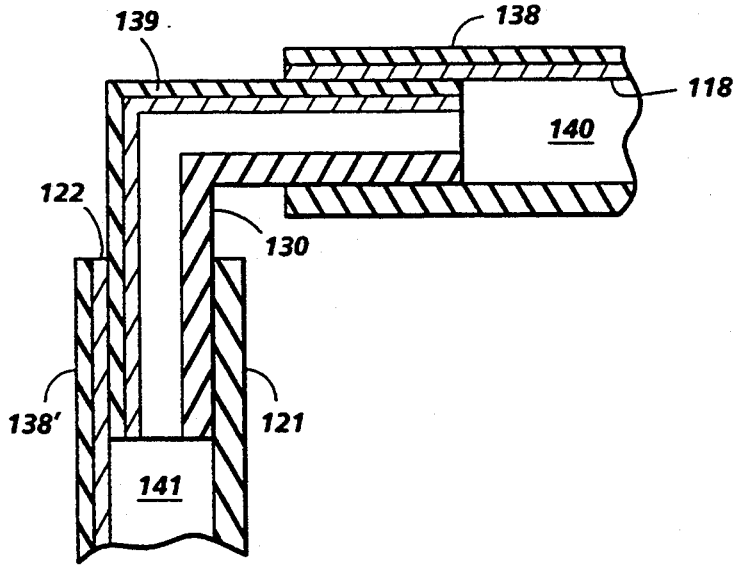

In addition, in accordance with the present invention by the use of various configuration of the frames or frame pieces of the frame of a machine, the normal use, of wire harnesses and cables in a machine can be minimized or eliminated. Thus, with layers of material of different electrical characteristics, elements of the machine frame can be introduced into a variety of electrical networks and circuits. FIGS. 3 and 4 illustrate machine frame configurations for use of the frame as an electrical component. A frame assembly 115 is constructed with pultruded frame members 117–128 carrying circuit bus and power conductors (not shown) running continuously along the periphery of at least one surface of the structure. Corner joining members 130–137 mechanically interconnect the pultruded frame members 117–128, and also establish electrical connections between selected ones of the circuit bus and power conductors carried on the pultruded frame members. FIG. 4 is an enlarged view of a corner section taken at the section 4—4 in FIG. 3 and illustrates an arrangement in which circuit paths 138 and 138' are located on the outer walls 140 and 141 of the respective pultruded frame members 118 and 122 to be interconnected by a conductor 139 on the outer walls of the corner section 131. Connections may be established to the conductors of the pultruded frame members 118–127 or the various connectors 130–137 at any desired location along the length of the frame members or connectors to facilitate conduction of desired signals or voltages to various machine parts by the frame assembly 115.

Figure 5:
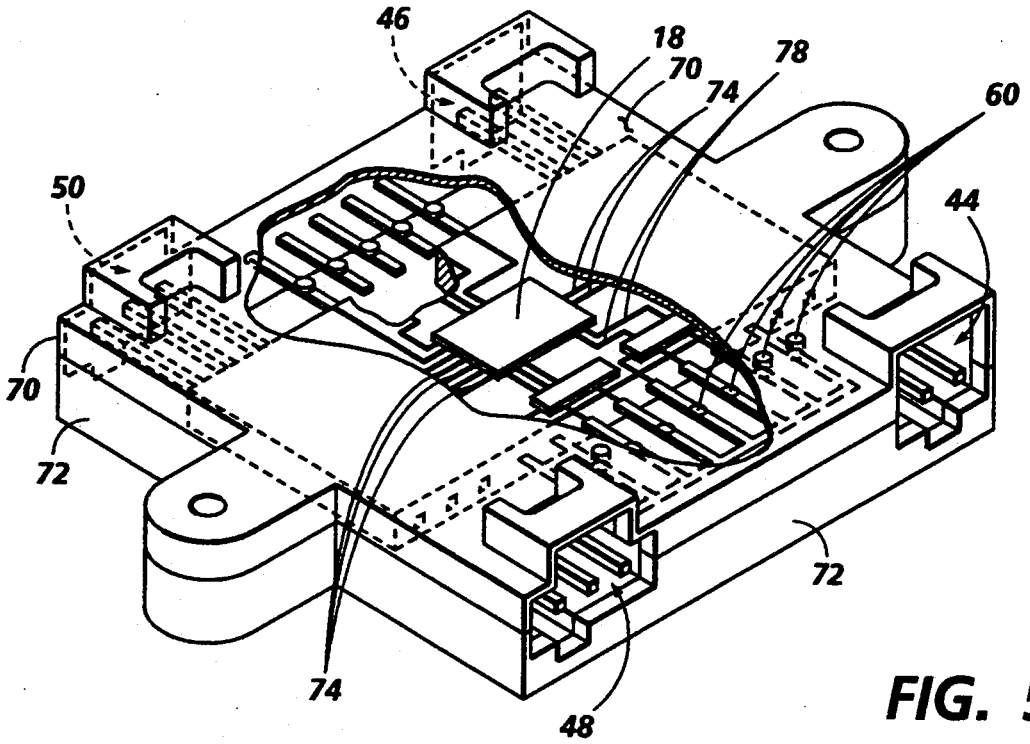
FIG. 5 is an alternate embodiment of the connector module of FIG. 1 in accordance with the present invention.
Figure 6:
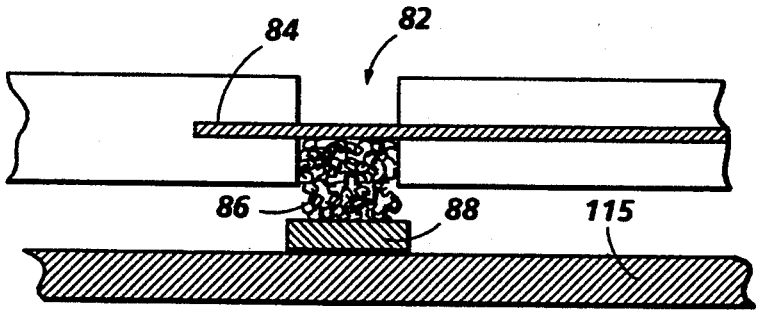
FIG. 6 illustrates the interconnection of the module of FIG. 5 to a frame conductor in accordance with the present invention.

In accordance with the present invention, FIGS. 5 and 6 illustrate an interconnection technique to mate or interconnect a connector module or device to a support such as a machine frame as disclosed in FIG. 3 or to a typical printed wiring circuit board.

In accordance with the present invention, in FIG. 5 there is illustrated a two-piece module including a single lead frame element 70 and a bottom closure piece 72 suitably affixed to form a connector module. The lead frame element 70 is similar to the lead frame assembly 16 illustrated in FIG. 2, in particular showing 2-pin connectors 44 and 46, 3-pin connectors 48 and 50, IC chip 18, and also illustrating various conductive traces 74 between the pin connectors and the chip 18. In addition, conductive traces 78 are illustrated interconnecting the program punchout elements 60 to chip 18. As discussed above, the punchouts 60 provide the means to program a particular connector module for inputs or outputs in module addressing. The lead frame illustrated at 70 is molded in plastic and provides holes the terminus at the 3-pin connector 50 and 2-pin connector 46 to act as test points and provide tooling relief for the mold shutoffs. In accordance with the present invention, the molded upper element 70 also includes connector holes 82 as best shown in FIG. 6 to expose a lead frame conductor 84 for interconnection to a printer wiring board or conductive frame 115. Any suitable button contact 86 such as a Cinch button TM contacts or spring contacts interconnect the lead frame conductor 84 to a printed wiring board or frame conductor 88.

Figure 7:
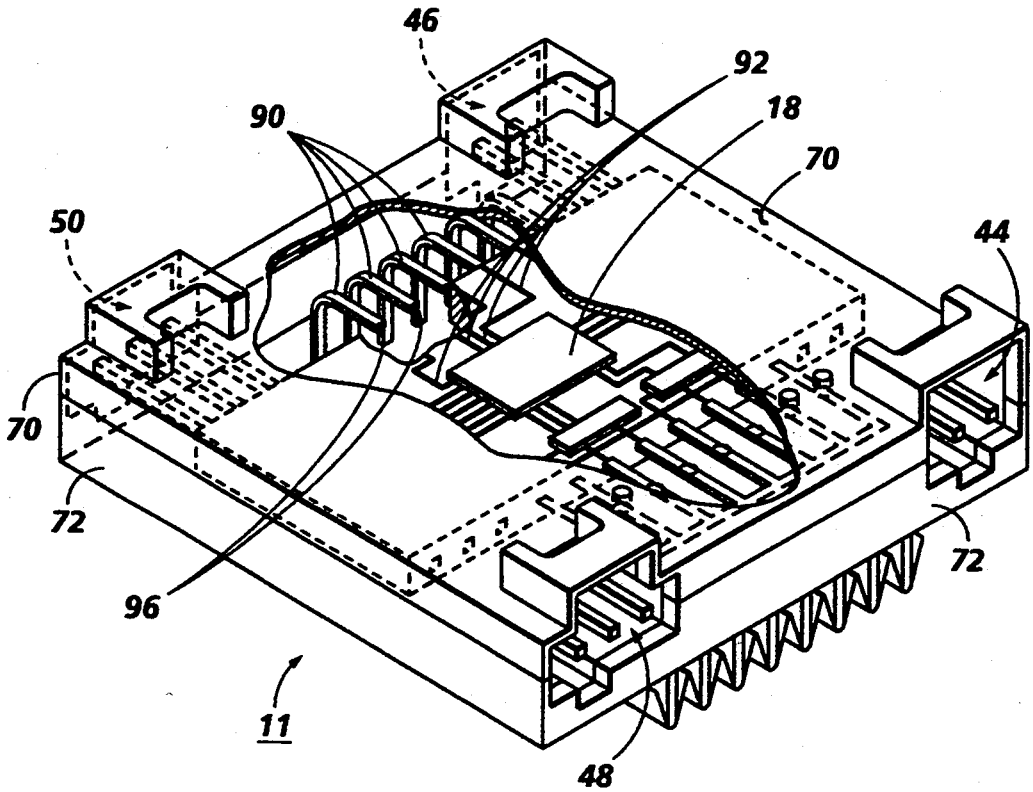
FIG. 7 is a modification of the connector module of FIG. 5 in accordance with the present invention.
Figure 8:
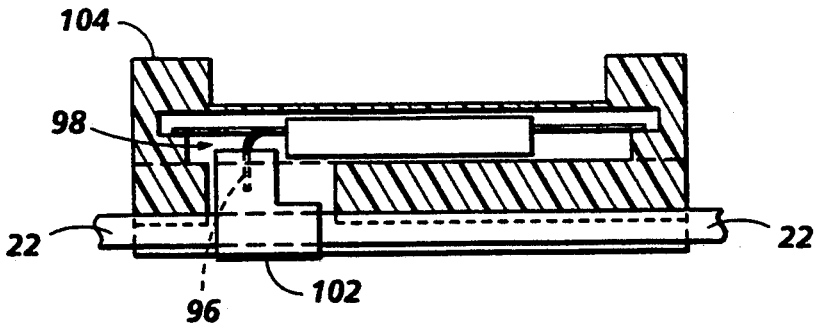
FIGS. 8 and 9 illustrate the interconnection of a connector module to a standard connector device in accordance with the present invention.
Figure 9:
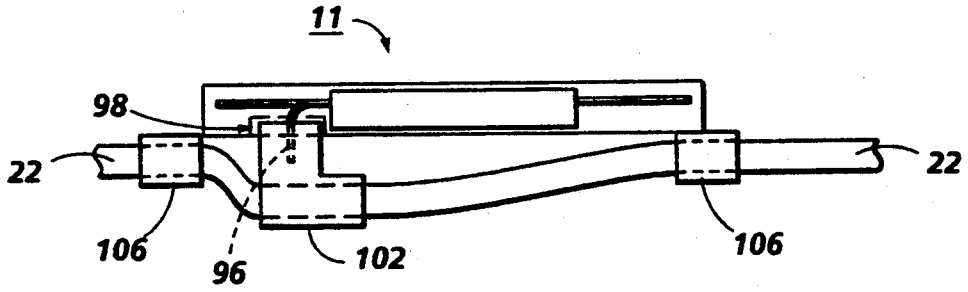

With reference to FIG. 7, there is illustrated another embodiment for interconnecting the connector module 11, soldered or plugged into a connector mounted on a printed wiring board or to a standard connector. In particular, five conductors 90 are illustrated interconnected to conductive traces 92 to the chip 18. The vertical portions 96 of the conductors 90 extend downwardly out of the bottom of the connector module 11 as illustrated in FIGS. 8 and 9 with an opening in the module illustrated at 98. As illustrated in FIG. 8, the lower conductive elements 96, only one of which is shown, extend into engagement with any suitable connector 102 such as the Molex K/K or Amp MT6. The connector module 11 is carried by any suitable support 104 also suitably connected to bus wires 22 also suitably carried by the support or housing 104. An alternate embodiment is shown in FIG. 9, wherein the connector module 11 is directly connected to the bus wires 22 secured by suitable strain relief elements 106.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

I claim:

1. A connector module for connecting at least one of an input device and an output device to a multi-wire bus, the module comprising:

a first stage supporting the multi-wire bus, said bus carrying signals for controlling input and output devices, a second stage having an IC chip mounted on circuit means, the circuit means including first electrical connections for connecting the input and output devices to the IC chip and second electrical connections for connecting said multi-wire bus to the IC chip for conveying said signals between said multi-wire bus and the input and output devices, the first and second electrical connections having been formed from a single lead frame, the second electrical connections including a plurality of stamped metal contacts, the stamped metal contacts being bent with an end formed for an insulation displacement connection with the multi-wire bus, and a stage fastener for interlocking the first stage to the second stage.

2. The module of claim 1 wherein the insulation displacement contact is essentially a V-shaped element.

3. A connector module for connecting at least one of an input device and an output device to a multi-wire bus, the module comprising:

a first stage supporting the multi-wire bus, said bus carrying signals for controlling input and output devices, a second stage having an IC chip mounted on circuit means, the circuit means including first electrical connections for connecting the input and output devices to the IC chip and second electrical connections for connecting said multi-wire bus to the IC chip for conveying said signals between said multi-wire bus and the input and output devices comprising a plurality of contact pieces with insulation displacement means for contacting the multi-wire bus including a stamped metal contact, the stamped metal contact being secured to the contact pieces, the first and second electrical connections having been formed from a single lead frame, and a stage fastener for interlocking the first stage to the second stage.

* * * * *